US009848719B2

(12) United States Patent
Littlejohn et al.

(10) Patent No.: US 9,848,719 B2
(45) **Date of Patent: *Dec. 26, 2017**

(54) DISPOSABLE FLUTED PAPERBOARD PLATES AND METHOD OF MAKING SAME

(71) Applicant: GPCP IP Holdings LLC, Atlanta, GA (US)

(72) Inventors: Mark B. Littlejohn, Appleton, WI (US); Michael A. Breining, Neenah, WI (US); Larry A. Mejeur, Lawrence, MI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/400,872

(22) Filed: Jan. 6, 2017

(65) Prior Publication Data

US 2017/0112305 A1 Apr. 27, 2017

Related U.S. Application Data

(63) Continuation of application No. 11/778,232, filed on Jul. 16, 2007, now Pat. No. 9,555,594.
(Continued)

(51) Int. Cl.
*B65D 1/00* (2006.01)
*B31B 45/00* (2006.01)
(Continued)

(52) U.S. Cl.
CPC ..... *A47G 19/03* (2013.01); *B65D 1/34* (2013.01); *B31B 50/44* (2017.08);
(Continued)

(58) Field of Classification Search
CPC ..... B31B 45/00; B31B 2201/2654; B31B 2201/2695; B31B 2203/062; B31B 2203/064; A47G 19/03
(Continued)

(56) References Cited

U.S. PATENT DOCUMENTS 221,564 A 11/1879 Johnson
1,073,618 A 9/1913 Muller
(Continued)

FOREIGN PATENT DOCUMENTS

CH 385618 A 12/1964
NL 7410482 A 2/1975

OTHER PUBLICATIONS

PCT International Preliminary Examination Report for PCT/US2007/073592, dated Mar. 26, 2009.
(Continued)

*Primary Examiner* — Christopher Demeree

(57) ABSTRACT

A paperboard plate such as a paper plate includes a generally planar bottom portion, an upwardly and outwardly extending fluted sidewall, wherein the sidewall comprises a plurality of sidewall flutes substantially around the outer perimeter of the plate to define a fluted perimeter. The flutes are suitably present at fewer than 3.5 flutes per inch; the plate has a radial profile with a single transition; and the diameter/flute length ratio is greater than 6. The plates are formed in a punch-through die cutting and forming tool from a plurality of paperboard web layers at increased productivities as compared with conventional heated press-forming.

27 Claims, 11 Drawing Sheets

Related U.S. Application Data

(60) Provisional application No. 60/807,533, filed on Jul. 17, 2006.

(51) Int. Cl.

| | |
|---|---|
| ***A47G 19/03*** | (2006.01) |
| ***B65D 1/34*** | (2006.01) |
| *B31B 50/44* | (2017.01) |
| *B31B 100/00* | (2017.01) |
| *B31B 120/70* | (2017.01) |
| *B31B 110/10* | (2017.01) |
| *B31B 110/20* | (2017.01) |

(52) U.S. Cl.
CPC ..... *B31B 2100/00* (2017.08); *B31B 2110/10* (2017.08); *B31B 2110/20* (2017.08); *B31B 2120/70* (2017.08)

(58) Field of Classification Search
USPC ..... 229/406, 5.84; 220/574
See application file for complete search history.

(56) References Cited

U.S. PATENT DOCUMENTS

| | | | |
|---|---|---|---|
| 1,164,962 | A | 12/1915 | Sayford |
| 1,457,998 | A | 6/1923 | Norwood |
| 1,607,863 | A | 11/1926 | Betts |
| 1,607,864 | A | 11/1926 | Butler |
| 1,844,500 | A | 2/1932 | Dailey |
| 2,014,815 | A | 9/1935 | Rutledge |
| 2,288,304 | A | 6/1942 | Schlattner |
| 2,483,735 | A | 10/1949 | Noell |
| 2,495,659 | A | 1/1950 | Noell |
| 3,033,434 | A | 5/1962 | Carson |
| 3,460,670 | A | 8/1969 | Stakel |
| 3,517,580 | A | 6/1970 | Sturm |
| 3,550,421 | A | 12/1970 | Stakel |
| 3,938,727 | A | 2/1976 | Andersson |
| 4,026,458 | A | 5/1977 | Morris et al. |
| 4,075,107 | A | 2/1978 | Smith |
| 4,094,234 | A | 6/1978 | Olney et al. |
| 4,101,627 | A | 7/1978 | Menier |
| 4,606,496 | A | 8/1986 | Marx et al. |
| 4,679,724 | A | 7/1987 | Inagaki |
| 4,721,500 | A | 1/1988 | Van Handel et al. |
| 5,326,020 | A | 7/1994 | Cheshire et al. |
| 5,577,989 | A | 11/1996 | Neary |
| 6,364,203 | B2 | 4/2002 | Toussant et al. |
| 6,527,687 | B1 | 3/2003 | Fortney et al. |
| 6,715,630 | B2 | 4/2004 | Littlejohn et al. |
| 6,959,634 | B2 | 11/2005 | Gross et al. |
| 7,048,176 | B2 | 5/2006 | Littlejohn et al. |
| 2004/0043168 | A1 | 3/2004 | Ishikawa et al. |
| 2004/0052987 | A1 | 3/2004 | Shetty et al. |
| 2007/0042072 | A1 | 2/2007 | Johns et al. |

OTHER PUBLICATIONS

International Search Report for PCT/US2007/073592 dated Apr. 8, 2008.

Written Opinion of the International Searching Authority for PCT/US2007/073592 dated Apr. 8, 2008.

Kirk-Othmer, Encyclopedia of Chemical Technology, Third Edition, vol. 17, pp. 798, 799, 815, 831-836.

DISPOSABLE FLUTED PAPERBOARD PLATES AND METHOD OF MAKING SAME

CROSS REFERENCE TO RELATED APPLICATION

This application is a continuation of co-pending U.S. patent application Ser. No. 11/778,232, filed on Jul. 16, 2007, which is based upon U.S. Provisional Patent Application Ser. No. 60/807,533, filed Jul. 17, 2006, all of which are incorporated by reference herein.

FIELD OF THE INVENTION

The present invention relates to paperboard plates and, more particularly, to disposable paperboard plates made by concurrently forming multiple paperboard layers in a punch-through die forming tool. Stacks of greater than 5 and up to about 20 or more individual plates can be formed in one cycle using the methods and paperboard webs of the present invention.

BACKGROUND OF THE INVENTION

Pressed-formed paperboard containers, in particular, plates, are known in the art. See generally U.S. Pat. No. 6,715,630 to Littlejohn et al, which disclosure is incorporated herein in its entirety by this reference. Such plates are typically formed by pressing paperboard in a heated matched metal die set. Surface temperatures in the mold are typically on the order of about 300° F. and above and the plates are formed under high pressure to provide permanent shape and strength to a product that typically comprises pleats on the sidewalls and rims. The pleats comprise integrated fibrous structures formed from multiple paperboard layers under heat and pressure such that the pleats are generally inseparable into their constituent layers when the plate is being used. Examples of such pressboard plates are sold by the assignee of the present invention under the tradenames DIXIE® and DIE ULTRA®.

Other types of disposable plates formed from paper can be formed from a slurry of pulp. Such a slurry is molded to provide a paperboard plate. An example of such a pulp-molded product is sold as by the Huhtamaki Corporation as CHINET®.

Such pressboard and pulp-molded paper plates have achieved widespread acceptance in the marketplace. However, these types of plates are considered to be "premium" products and are generally used by persons who desire a high-end product. Specifically, these plates generally are priced several times more than so-called "economy plates."

Another type of disposable plate is typically used by persons who desire a lower cost disposable paperboard plate. Such plates are fluted "economy" plates, also known as "white no-print" plates ("WNP plates"). WNP plates are formed by simultaneously pressing from 2 to 5 layers of paperboard at a time. Prior art WNP plates exhibit a fluted pattern in their rim area to take up the extra material during formation due to the reduction in perimeter of the plate into the final product resulting from material gathering.

Prior art WNP plates currently make up a significant portion of the market for paper plates because of their significantly lower cost than the so-called "premium" plates discussed previously. In particular, this market segment has been estimated to be up to 60% of disposable plate market volume. Prior art WNP plates are commonly formed with about 100 pounds per ream uncoated paperboard or from about 150 to about 170 pounds per ream clay coated paperboard.

Referring to FIG. 1 herein, a prior art WNP plate (that is, a WNP plate made using prior art pressing processes) is shown. In this Figure, plate 10, which includes a bottom 12, a center transition 14, a lower sidewall transition 16, a fluted sidewall 18, an upper sidewall transition 20, and an outer pleated shelf 22. These plates are typically prepared from a stack of pre-cut paperboard blanks under pressure in a matched metal die set. However, because of the high temperatures and pressures used in forming, prior art WNP plates can often be difficult to separate, especially when interlayer pleating or folding of the plates occurs during the pressing process. As would be readily recognized by anyone who has used WNP plates, it is very frequently difficult to remove a single plate from a stack of plates because the individual plates stick together. This leads to waste since multiple plates are used when only one is required. Thus, even though on an individual basis the plates are less expensive than so-called "premium plates," as used, prior art WNP plates can approach the cost of the more expensive plates if 2 or 3 or more plates cannot be separated for individual use.

The inventors herein have discovered a punch-through die forming process that provides an improved method for preparing WNP plates such that the plates are less likely to stick together. The method of the present invention also provides a more efficient manufacturing process wherein time, materials and energy can be saved in the manufacture of the WNP plates of the present invention. A paperboard material having a treatment making the resulting plates water, grease or oil resistant can also be used in the invention herein. A new type of WNP plates and stacks thereof are formed by the processes of the present invention.

SUMMARY OF THE INVENTION

The WNP plates of the present invention are formed in a punch-through die cutting and forming tool from a plurality of paperboard webs. The method of the present invention provides increased productivities as compared with prior press-forming preparation of WNP plates. The WNP plates of the present invention exhibit a single radial profile transition and provide adequate strength for use as plates. A WNP plate of the present invention includes a generally planar bottom portion, an upwardly and outwardly extending fluted sidewall, wherein the sidewall comprises a plurality of flutes substantially spanning the outer perimeter of the plates, thereby defining a fluted perimeter. The flutes are suitably present at fewer than about 3.5 flutes per inch and the diameter/flute length ratio is greater than about 6. The WNP plates of the present invention can also be made with treated paperboard to provide improved barrier properties as compared to prior art WNP plates. Stacks of the WNP plates of the present invention are also provided herein.

Other advantages of the invention will become apparent by review of the specification that follows.

BRIEF DESCRIPTION OF THE DRAWINGS

The invention may be better understood with reference to the Figures wherein like numerals designate similar parts and wherein.

DETAILED DESCRIPTION

The invention is described in detail below with reference to several aspects and numerous examples. Such discussion is for purposes of illustration only. Modifications to particular examples within the spirit and scope of the present invention, set forth in the appended claims, will be readily apparent to one of ordinary skill in the art. Terminology used herein is given its ordinary meaning consistent with the exemplary definitions set forth immediately below; mils refers to thousandths of an inch, basis weight refers to pounds per ream and so forth.

Product or apparatus dimensions are based on average dimensions, taken at about 4 or more equally spaced locations around a product or part.

"Diameter" for the WNP plates of the present invention a frustoconical plate refers to the maximum diameter of the product, as measured from one end to another from the respective outer rims of the plates. For shapes other than precisely frustoconical plates, the average diameter through the center of the plate to the rim is used for purposes of calculating the diameter/flute length ratio. The product diameter is also used to describe the number of flutes per inch of circumference.

"Ream" refers to 3000 square feet of paperboard.

A typical product of the present invention made from an about 9.375 inch diameter paperboard blank and has a product diameter of 9 inches and about 50 flutes having a flute length of 1⅜ inches. Such a plate has a diameter to flute length ratio of about 7.2 and has about 6.5 flutes per inch of circumference.

"Flutes per inch" refers to flutes per inch of plate circumference based on the product diameter as noted above.

Figure 1:
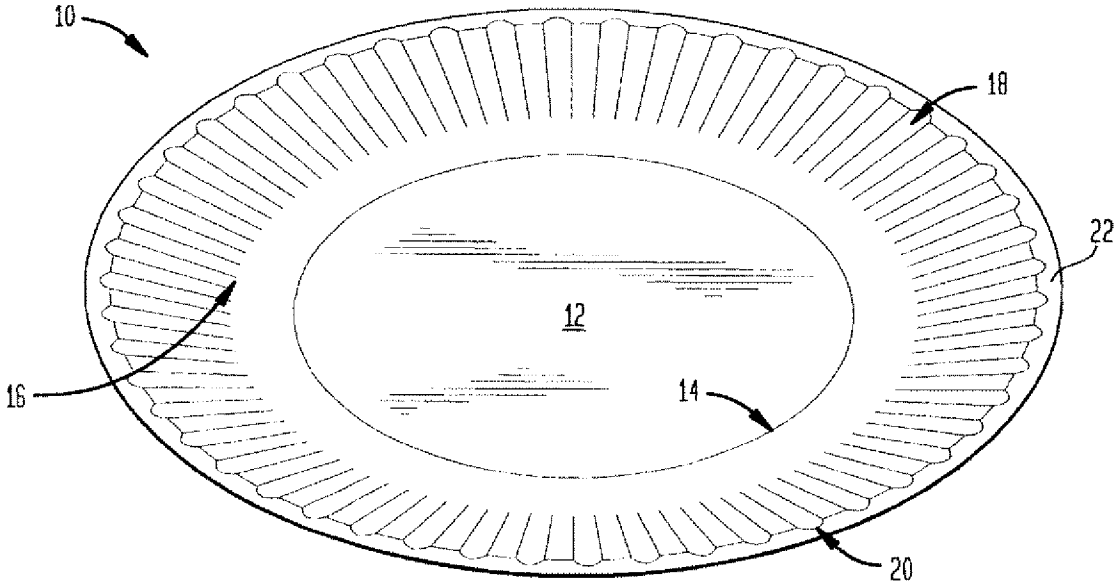
FIG. 1 (PRIOR ART)
FIG. 1 is a perspective view of a prior art WNP economy disposable plate made by way of a matched pressware die set.

The terminology "radial profile with a single transition" refers to the product profile from center to outer edge, there being a single substantial transition from, to or through a horizontal plane at a bottom of the plate over this distance. This terminology excludes, for example, those geometries that include an outer horizontal shelf as shown in FIG. 1 and those geometries where the sidewall transitions through horizontal to an outer downturn at the rim. It will be appreciated from the discussion that follows that the profile of a fluted product varies slightly depending on the section of the flute from which the profile is taken. However, all of the profiles are substantially the same in that there is a single substantial transition in the profile that occurs at the base of the sidewall. The single transition defines the location where the fluted portion begins. The sidewall fluted portion may include some curvature or inflection due to processing of the paperboard, but such curvature or inflections do not prevent the WNP plates from having a single transition as defined herein.

"Sidewall angle" refers to the angle the plates sidewall makes with a horizontal parallel or coextensive with the bottom of the plate. For purposes of specifying the sidewall angle, the profile at a flute trough (that is, the lower most portion) is used and the sidewall profile is treated as linear as measured from its outermost portion.

"Unfluted" portions between ribs refers to portions of the punch or die sidewall between ribs that follow generally the overall dimensions of the parts without ribs. Thus, unfluted portions of an about 6.6 inch diameter punch for making a nominal 9 inch plate have a radius of curvature of about 3.3. The total "perimeter" distance over the fluted and unfluted portions of the punch and die are typically equal to the circumference of the paperboard blank used. For example, an about 6.625 inch fluted punch for forming an about 9.375 inch blank into a nominal 9 inch plate has a fluted perimeter of about 29.45 inches total around the circumference thereof.

The plate-forming method of the present invention is referred to here as the "punch-through die" formation method in contrast to the matched metal pressware methods noted above.

The word "plate" is used herein for convenience because the present invention has immediate application for use in providing and manufacturing containers in addition to plates, and methods of making the same. However, one of skill in the art will recognize that the articles and methods of the present invention will be useful generally for plates or other articles where the features of the present invention can be appropriately used.

Although the plates herein are referred to as "white no print" plates, thus signifying that the plates are white and not printed, it should be appreciated that the plates can be of any color from which paperboard webs can be prepared. For example, a die or other colorant can be added during manufacture of the paperboard web, therein providing a plate having a color. Also, although the plates are generally not printed, it will be appreciated that the plates can be made from treated paperboard as described in further detail herein. Such treatments can include designs or patterns that might be considered to comprise printing.

The present invention relates generally to WNP plates, stacks of WNP plates and punch-through die methods of manufacture. As discussed above, such plates are lower in cost than premium paper plates and are known in the art as "economy" plates.

In making the WNP plates of the present invention, a plurality of paperboard webs are fed to a die in a layered configuration and a punch-through forming system is used to produce the fluted plates of the invention. The paperboard webs are combined, cross-directionally aligned with each other and fed into the forming die and punch-through system. In this process, the plurality of paperboard webs are substantially simultaneously held together, cut into blanks and punch-through formed into a fluted female die by a fluted male punch. Web scrap formed during the process can be fed outward from the die set during subsequent machine cycles and can be removed by a vacuum scrap chute system. A plurality of punch-through die formed WNP plates, which are configured in a stack of from greater than 5 to as many as about 20 or about 25 individual plates, continue to be moved through the female fluted die, typically to a subsequent stacking/sizing station and take-away conveyor.

As the paperboard webs collectively move through the punch-through die, the sidewalls of the WNP plates are oriented substantially perpendicular to the plate's bottom as they pass through the female die. Upon the exit of the webs from the female die, the sidewalls individual plates arranged in stack form substantially relax to provide a finished product that visibly resembles a prior art WNP plate. However, the WNP plates of the present invention exhibit features that are substantially different from those of prior art WNP plates.

The present invention provides a lower cost WNP plate than has been previously available with prior art WNP plates because substantially more paperboard webs can be simultaneously converted into individual plates. Moreover, less expense for machinery, raw materials and energy are required because of the very high output rates that are readily achieved in the present invention.

By way of background, existing products made using punch-through die forming methods are typically light weight products such as coffee filters, cupcake cups, cake pan liners or hot dog trays and the like. These products are readily distinguished from the products of the present invention by at least the prior art products' lower basis weight, relatively steep sidewall angles, deep flutes and the number of flutes per inch of circumference as is appreciated from FIGS. 2-4.

Figure 2:
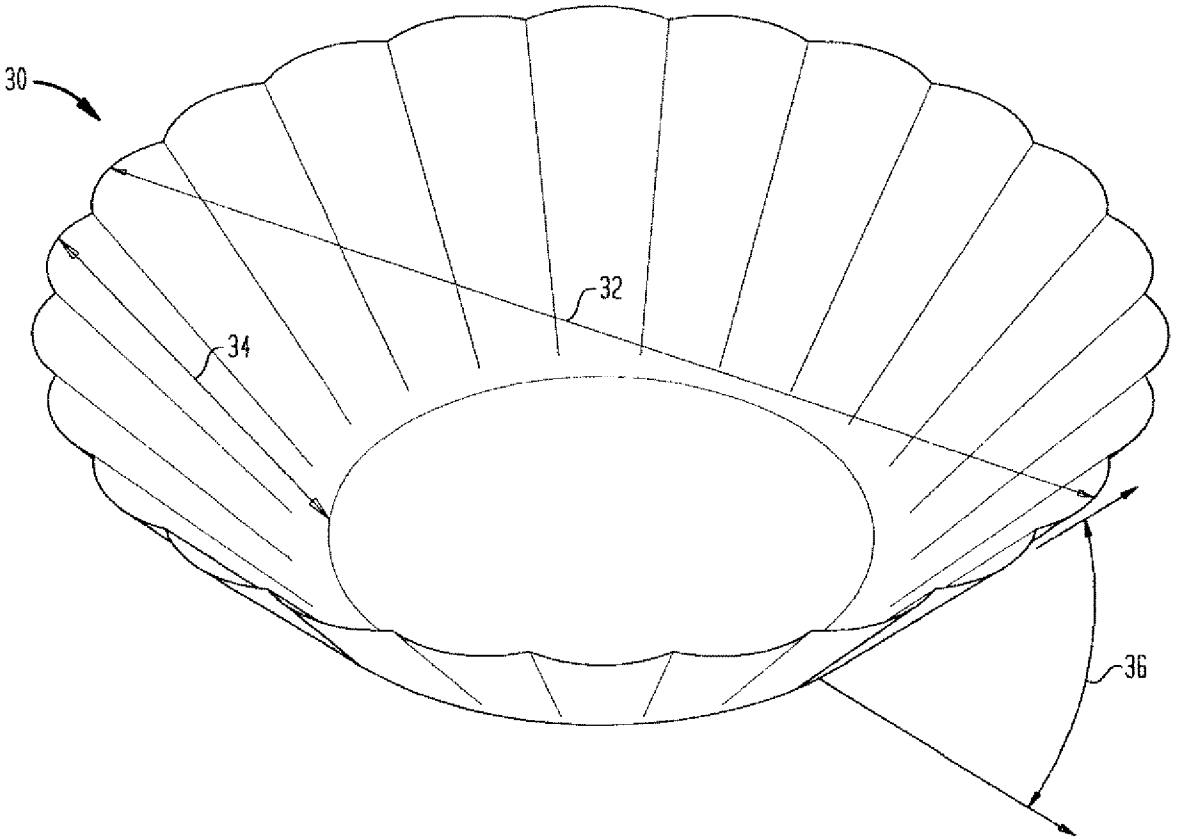
FIG. 2 (PRIOR ART)
FIG. 2 is a perspective view of a prior art through-formed coffee filter.

For example, FIG. 2 illustrates a typical commercial size through-formed coffee filter 30, having a diameter 32 and a plurality of flutes (approximately 1 flute per inch). The basis weight of the product appears to be in the about 30 to about 40 per ream pound range. The diameter 32 of the coffee filter from which FIG. 2 was prepared was about 7.5 to about 8 inches with a flute length 34 of about 2.5 inches such that the diameter/flute length ratio is less than 3.5. Moreover, the coffee filter tends to have a sidewall angle 36 of greater than 60°. A single filter will be unable to support weight in the sidewall region weight due to its low strength. That is, if weight is placed in the sidewall region of a coffee filter, the wall will collapse during use.

Figure 3:
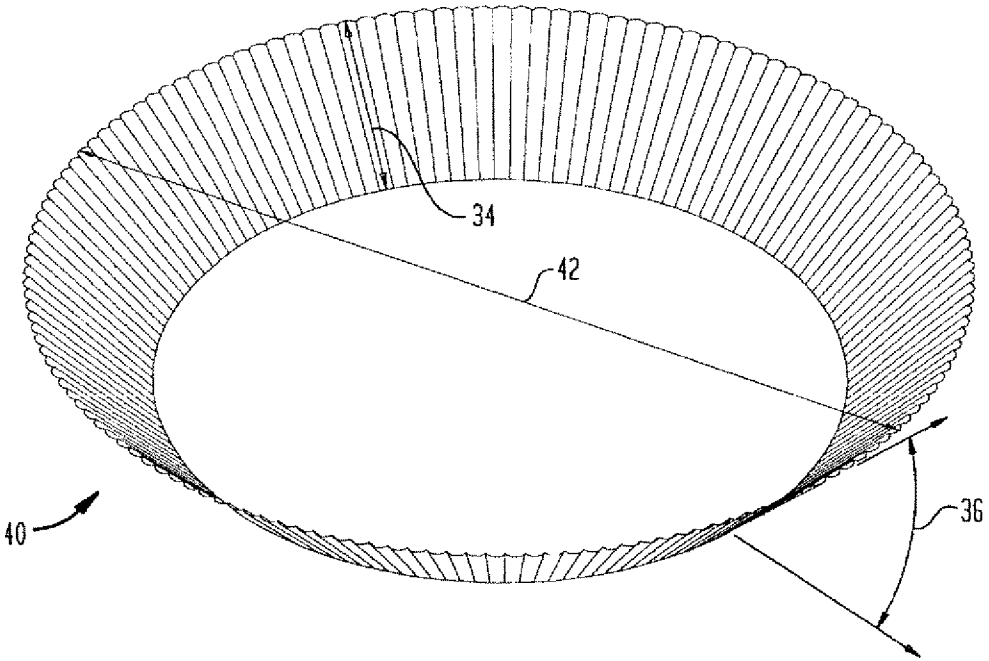
FIG. 3 (PRIOR ART)
FIG. 3 is a perspective view of a prior art cake liner.

FIG. 3 is a representation of a cake liner 40, having a basis weight of less than about 30 pounds per 3000 square foot ream. The cake liner from which FIG. 3 was prepared has a diameter 42 of about 9 inches and a relatively steep sidewall angle 36. The flute length 34 was about 1.5 inches and there were about 120 flutes or about 4.2 flutes per inch of circumference.

Figure 4:
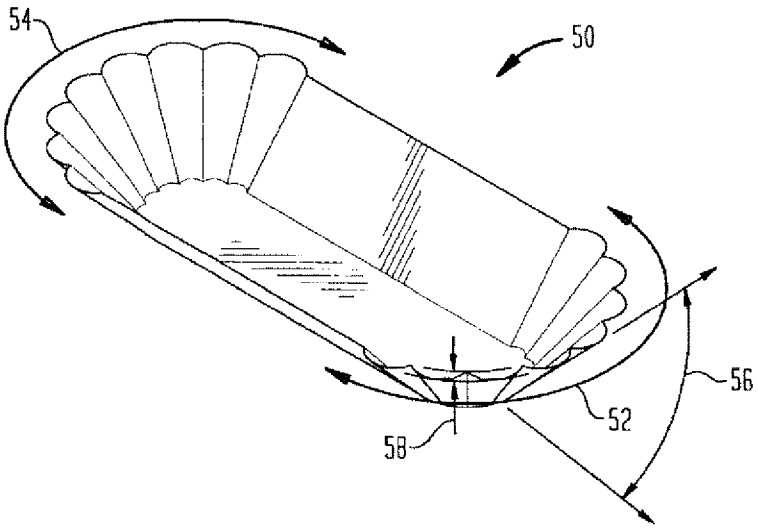
FIG. 4 (PRIOR ART)
FIG. 4 is a perspective view of a prior art hot dog tray.
Figure 5:
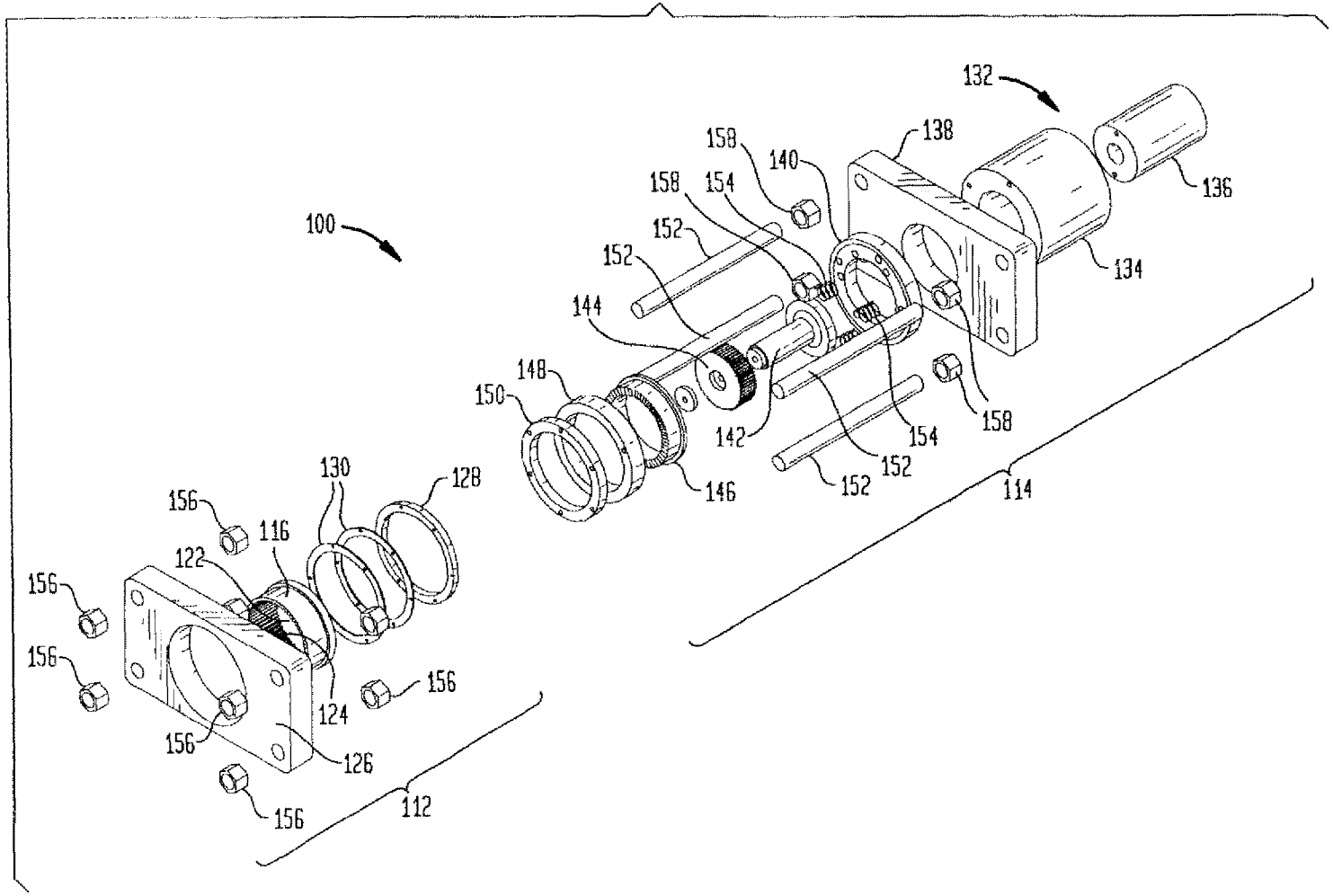
FIG. 5 is a perspective exploded view of a punch-through die cutting and forming tool 100 viewed generally from the die side of the apparatus.
Figure 6:
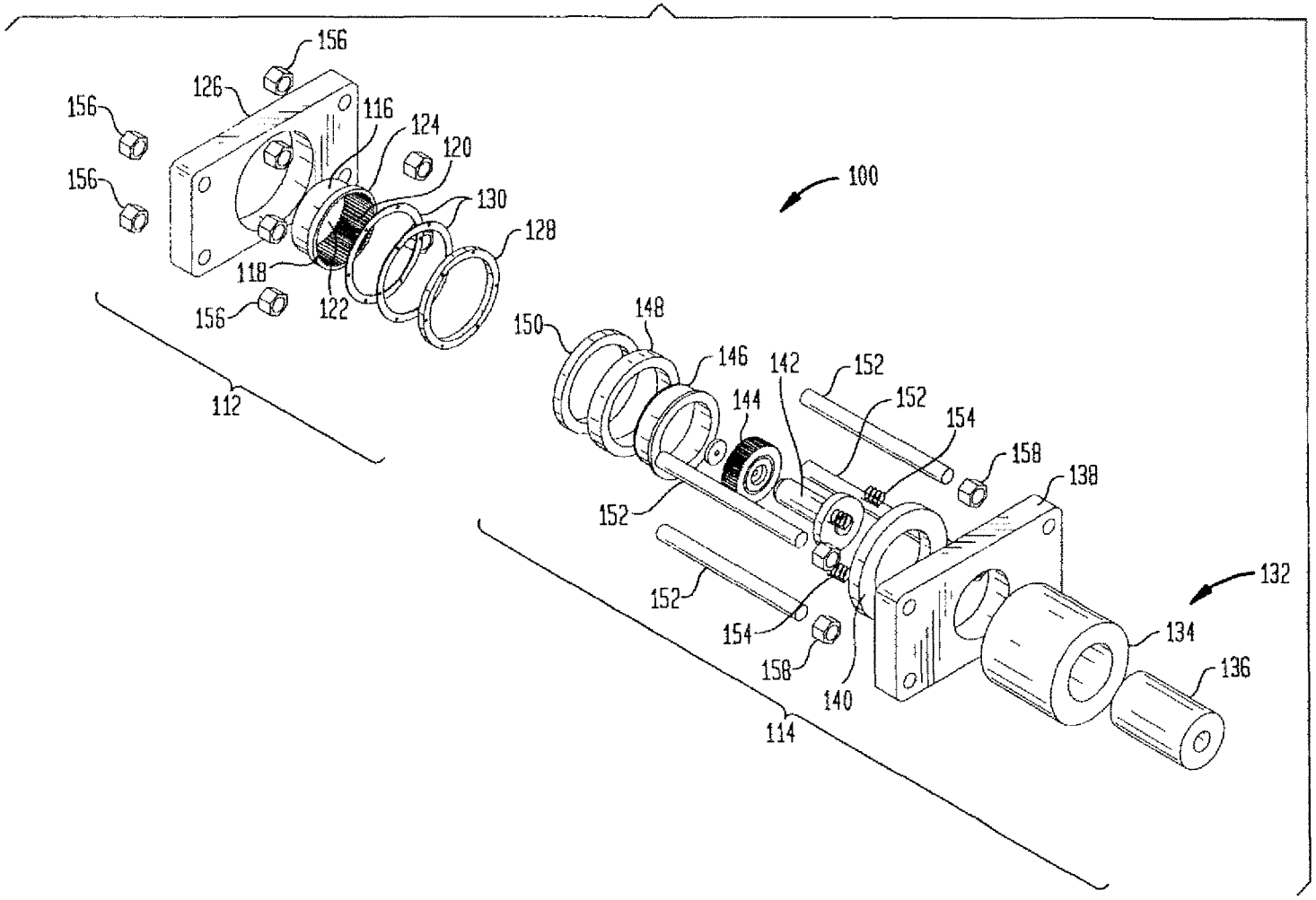
FIG. 6 is an exploded perspective view of tool 100 viewed generally from the punch side of the apparatus.
Figure 7:
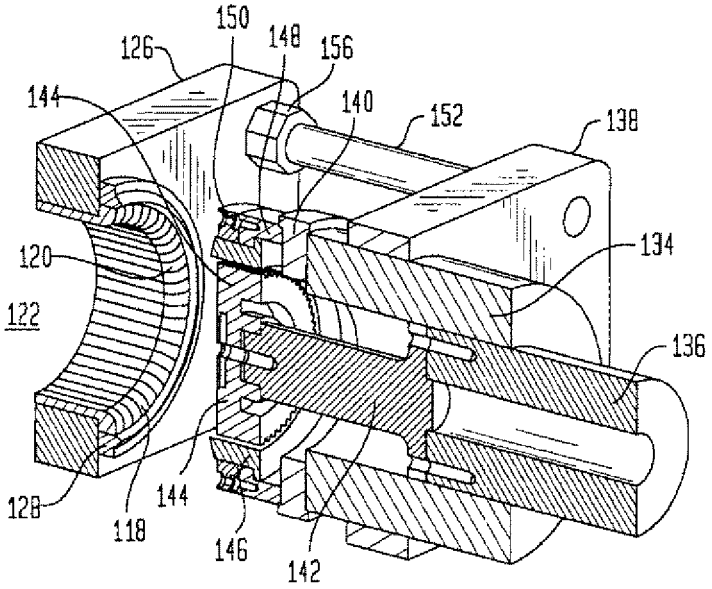
FIG. 7 is a view in perspective and section of the punch through cutting and forming tool of FIGS. 5 and 6.

FIG. 4 is a view in perspective of a hot dog tray 50 provided with fluted ends 52 and 54. Fluted hot dog trays, commonly used at sports arenas or by street vendors, are typically made with about 50 to about 60 pounds per ream. This product appeared to be made with paperboard appearing to have a basis weight of up to about 60 pounds per ream and had a sidewall angle 56 of about 45°. Moreover, it should be noted that the flutes of the hot dog tray were relatively deep having a flute depth 58 of about ¼ inch or so.

Such fluted coffee filters, cake pan and cup cake liners are commonly made with about 25 to about 30 pounds per ream. Such prior art punch-through products typically have a very large number of flutes (about 120 for cake liners) or have flutes that are fairly deep (coffee filters and hot dog trays). These products are produced with a sidewall having relatively steep sidewall angles to contain intended items.

In contrast to other punch-through die products (such as cake liners, hot dog trays and the like), the WNP plate products of this invention are typically formed with paperboard having a basis weight of at least about 75 pounds per ream or greater. Ninety (90) lbs per ream or higher paperboard basis weights can be useful to impart more strength to the product. Still further, the paperboard can have basis weights of from at least about 75 pounds per ream to about 160 pounds per ream. Yet further, the paperboard can have basis weights of at least about 75, 85, 95, 100, 110, 120, 130, 140, 150 or 160 pounds per ream, where any value can form an upper or lower endpoint, as appropriate.

In the method of the present invention, one or more dies can be present on the punch-through forming press apparatus. The manufacturing method of the present invention can be practiced, for example, with one or two or three or more dies arranged across a punch-through forming press. This is in comparison to prior art matched die set forming methods used to prepare typical WNP plates using heated die sets.

In particular, the prior art methods have about five dies across the forming press and are capable of punching a maximum of about five layers of paperboard pressed at one time. Premium pressboard plates, on the other hand, are formed one layer at a time.

WNP plates found in the prior art formed with from about 2 to 5 layers of paperboard, in a nested blank pattern of from 4 to 5 across the width of the press/roll width and at speeds ranging from about 40 to 60 (maximum) cycles per minute. Prior art WNP plate productivity thus ranges from about 320 plates to about 1500 plates per minute per forming press. In the method of the present invention, greater than 5 to as many as about 20 or 25 webs (layers) of, for example, about 100 lbs per ream paperboard can be fed into and formed with a punch-through die forming station at speeds of from about 40 to about 70 cycles per minute. Thus, plate output from a 3 across press used in the present invention is several times that of prior art heated pressware forming tools used to prepare standard WNP plates. In one example where a 3 across set-up is used in the present invention, up to about 4200 plates (3 wide×20 webs×70 cycles per minute) per press per minute versus about 1500 plates (5 wide×5 webs× 60 cycles per minute) per press per minute for conventional matched set processing of WNP plates with a five-across forming set-up.

Among the advantages of the invention over matched metal die pressware forming used to prepare prior art WNP plates is that the present invention can be formed with up to about 20 or as many as about 25 paperboard web layers at equivalent or higher press speeds than conventional pressware-formed WNP plates. In particular, the WNP plates of the present invention can be formed from greater than 5 or about 8 or about 12 or about 16 or about 20 or about 25 paperboard web layers. Still further, the WNP plates of the present invention can be formed from about 6, 7, 8, 9, 10, 11, 12, 13, 14, 15, 16, 17, 18, 19, 20, 22 or 25 paperboard webs, where any value can be used as an upper or lower endpoint, as appropriate. Upon completion of a pressing cycle, the number of paperboard stacks pressed at one time defines a stack of individual plates as is discussed in more detail later herein.

The plates can have from about 40 to about 80 flutes around the circumference thereof. Still further, the plates can have from about 50 to about 60 flutes around the circumference thereof. Yet further, the plates can have from about 30, 35, 40, 45, 50, 55, 60, 65, 70, 75, 80, 85 or 90 flutes around the circumference thereof, where any value can form an upper or lower endpoint, as appropriate.

The WNP plates of the present invention have differently shaped flutes than those found in prior art pressboard plates and prior art WNP plates. Still further, the flutes of the WNP plates of the present invention are arranged substantially uniformly around the circumference of the plates. This is in contrast to, for example, hot dog trays, which as shown in FIG. 4, exhibit substantial lengths around the circumference that are not fluted.

Still further, the WNP plates of the present invention exhibit sidewalls substantially relaxed from vertical. The sidewall angle can be less than about 60° from as measured from the horizontal (i.e., 0°). Still further, the sidewall angle can be less than about 55°, 50°, 45°, 40° or 35° from horizontal. Since immediately after formation the WNP plates can have an angle of greater than 60°, the angle of the WNP plates of the present invention are suitably measured after the plates are provided with the opportunity to relax somewhat. As such, the angle is measured when there is seen less than 5% change in the angle within about 24 hours when a stack of 20 plates is placed with the generally planar bottom on a flat surface. The humidity and temperatures under which the stack is conditioned prior to measurement of the angle are 20% and ambient, respectively.

The angles of the WNP plates of the present invention are in contrast to typical products formed from punch-through processes that have much greater angles in the sidewalls thereof. In order to achieve the look and feel of a prior art WNP plate, however, the sidewall angle should be at least about 15° or at least about 20° or at least about 25°.

In conventional matched-set processing used to prepare prior art WNP plates, the paperboard webs are fed into the pressing area where they are blanked, transferred down a blank transfer chute into a matched metal (male and female) die set and ejected onto a take away table and into a stacking can where they are stacked. The matched metal die set imparts the desired plate shape, generally with flutes imparted to the stack of paperboard blanks under heat, moisture and force. Typically, matched metal heated die sets may have surface temperatures of about 300° F. or more. As noted above, the resulting stack of plates typically sticks together because of inter-pleating or by the effects of the heated processing they undergo during formation. Extra effort is thus required by the consumer to individually separate the plates from each other.

The WNP plates produced by punch-through die forming in accordance with the present invention provide significant advantages over conventional pressware economy plates in that they do not stick together during forming and can readily be separated from each other. Typically less heat is used in the punch-through die plate forming process thereby resulting in the individual plates being much less likely to stick together in use.

In particular, the inventors herein have found that the fluted pattern of the punch through forming die does not allow for inter-pleating of the layers because the die does not result in pleating as the term is generally known to one of ordinary skill in the art. It has been found that there is little and indeed almost no sticking together of the individual plates with use of the punch-through die WNP plates.

Chemicals or additives typically used in the manufacture of paperboard webs can suitably be used in that paperboard of the present invention. Internal chemical additives can be applied during the paperboard manufacturing process to improve the barrier resistance of WNP plates made from the paperboard. Still further, chemical treatments can be applied externally to the paperboard prior to manufacture of the plates to provide barrier properties to the finished plates.

Treatment can be with coatings or other external or internal chemicals suitable to provide barrier properties to the plates in use. Such treatments can substantially enhance the barrier properties of the WNP plates of the present invention. It is expected that such treatments can greatly improve the acceptability of the WNP plates of the present invention.

It is contemplated that external coatings can be applied to the paperboard webs by extrusion of a polymeric material onto the web. Either or both of the topside or backside (as determined by the orientation of the finished plates) can be coated to improve barrier properties of the WNP plates of the present invention. Such a polymeric coating can comprise a polyolefin such as polypropylene or polyethylene or polyester or some other suitable material or blends thereof. It would be expected that such a coating should be applied to provide a thin coating in the range of about 0.1 to about 2.0 mil so as to keep the cost of the plates low and to maintain the general look and feel of prior art WNP plates.

An extruded polymeric film can be separately prepared and laminated to the paperboard web prior to preparation of the WNP plates of the present invention. The extruded film, which can be polypropylene, polyethylene or any other suitable polymer, can be laminated to the paperboard web with application of heat to cause the film to adhere to the web. Still further, the film can be applied to the paperboard web using an adhesive material.

Still further, the coating can be applied in liquid form, such as by spray or pad application. The types of polymeric materials that can be applied can be determined with reasonable experimentation. An example of coating that can be applied in this manner is latex, such as styrene butadiene rubber or an acrylic latex. Environmentally acceptable fluro-chemicals can also be used.

The coating can comprise any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Suitably, the latex comprises styrene-acrylic copolymer, styrene-butadiene copolymer, or vinyl acetate-acrylic copolymer. A commercially available vinyl acetate ethylene copolymer is "AIRFLEX® 100 HS" latex. ("AIRFLEX®100 HS" is a registered trademark of Air Products and Chemicals, Inc.) The latex can comprise a pigment. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in Kirk-Othmer, Encyclopedia of Chemical Technology, Third Edition, Vol. 17, pp. 798, 799, 815, 831-836. An available delaminated coating clay is "HYDRAPRINT" slurry, supplied as a dispersion with a slurry solids content of about 68%. "HYDRAPRINT" slurry is a trademark of Huber.

The latex can also contain additives that are well known in the art to enhance the properties of coated paperboard. By way of example, suitable additives include dispersants, lubricants, defoamers, film-formers, antifoamers and cross-linkers. By way of example, "DISPEX N-4" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercen. By way of example, "Foamaster DF-177NS" is one suitable defoamer. "Foamaster DF-122 NS" is a trademark of Henkel.

Yet further, the paperboard can be coated with a clay coating. Such coatings are commonly used in the art. The materials useful for such clay coatings are therefore known to those of ordinary skill in the art and will not be discussed in more detail herein.

It would generally be expected that application of a polymeric coating to a paperboard web used to prepare a WNP plate would cause the plates to be more likely to stick together because the high temperatures would cause the polymer to soften and then solidify when heat is removed. However, the inventors herein have found that it is possible to apply a polymeric coating to the paperboard web from which the WNP plates of the present invention are prepared. Since heat can applied to the plates in the manufacturing process for the plates of the present invention at temperatures below the melting point of any polymeric coating, it has been found that the presence of a polymeric coating does not increase the propensity of the finished plates to stick together or the plates to stick to the metal forming tool. This has been found to allow the barrier properties of the WNP plates of the present invention to meet or exceed those of the art WNP plates.

In one aspect, heat can applied during the preparation of the WNP plates of the present invention at less than about 180° F. Still further, heat can applied during the preparation of the WNP plates of the present invention at less than about 170, 160 or 150° F. In some aspects, it has been found that application of some heat can be beneficial to assist in the formation of the fluted portion of the plates, particularly when paperboard having a pre-applied polymeric coating is used.

A forming machine suitable for use in the present invention is available from Snyder Machine (Saugus, Mass.). Such fluted cut machines are typically used to form fluted products such as coffee filters, cake pan liners, cupcake liners and hot dog trays. The Snyder machines are further described on-line at www.snydermachine.com.

In prior art pressware systems used to prepare prior art WNP plates, rolls of paperboard webs are arranged on multiple stands arranged in line with the pressware forming press. The forming press must be shut down when any of the rolls run out of paperboard so that the correct number of plates in a package is obtained. The remaining "butt rolls" will likely all be removed and a new full size roll put on each of the unwind stands at this time. These butt rolls may be scrapped resulting in waste costs or fed to the press one at a time from an unwind stand so that the paperboard is not wasted. Feeding of the small rolls into the press result in frequent machine shut down for roll changes adding to the processing costs.

A significant benefit seen in the present invention is that machine down-time can be reduced. In particular, an array of roll unwind stands holds paperboard web rolls that are combined, cross-directionally aligned and fed into the punch-through die set. Machine downtime is minimal since new layers of paper can be indexed into the forming tool from extra unwind stands without shutting down the machine. The extra layer is fed into the forming tool just prior to a roll running out, thus providing consumers with about one extra product per package for a short press time. The feed roll pulling all of these rolls is typically constantly rotating and feeding the stack of paperboard webs. This eliminates the need (and inertial issues) to sequentially feed and stop all the rolls. An accumulation system such as an air cylinder/push rod or air cylinder/clamp rod can be used to stop the paperboard feed into the punch-through die die set during its forming cycle. The paperboard webs cannot he fed into the die set during the punch-through die forming cycle, which is why an accumulation system should be used in the method of the present invention. The various components of the punch-through die set are described in more detail below.

Punch-through die forming tools suitable for use in the present invention are generally strength enhanced so as to accommodate the additional stacked paperboard weight and thickness exhibited by the method of the present invention by addition of features such as pins and bushings in the forming ring/pressure pad to provide positive flute alignment. Additionally, die and punch components are typically aligned with a frame prior to the start of the manufacturing process, as discussed below.

It will be appreciated from the discussion that follows that the punch-through die forming cycle occurs in three distinct stages (which occur substantially simultaneously) between paper feeds into the die. In stage one, the punch forming ram moves forward until the forming ring/pressure pad contacts the stacked paperboard and the cutting ring cuts through the paperboard layers to produce a stack of blanks. In stage two, the punch side punch ram moves forward pushing the fluted male punch and the stack of paperboard blanks into the fluted female forming die, thus imparting a fluted pattern to the product. In stage three, both the forming ram and punch retract so that the next stacked paperboard length can be fed into the die and the waste trim fed out of the die. The waste trim can be disposed of by a vacuum chopper system.

The fluted stack of formed WNP plates continues to be pushed through the fluted female forming die by subsequent forming cycles. The distance of the forming die thus imparts a dwell time to form the paperboard into its fluted shape. Heat can be added to the forming die if desired to further set the shape, particularly when a polymeric coating is present on the paperboard web. As noted, if heat is applied, any such heat should be below the melting point of the polymeric coating to prevent sticking of the plates to each other or sticking of the paperboard web to the forming tool.

Steam/moisture can be added to the paperboard rolls prior to forming to aid in the formation process and reduce tearing and further define the fluted product shape if so desired. It has further been found that a lubricant, such as wax or cocoa butter, can be used in the forming process. A very small amount of lubricant applied to the paperboard web prior to WNP plate forming has been found to reduce the propensity of the resulting WNP plate to exhibit tearing or creasing in the center portion of the plate and in the fluted areas as it passes through the forming tool.

The stacked product (that is, a plurality of WNP plates where the plurality is defined by the number of paperboard webs which are punched simultaneously in a single punch) exits the fluted female forming die and can be further constrained by another set of guides or rails that further define, size or retain the desired WNP plate shape. This area may or may not be heated.

A marking system may be employed to mark a certain number of stacked products to aid in the packaging and so forth. Packaging can of course be automated or manual.

The rolls used for the punch-through die forming process may be somewhat smaller in diameter than those used in a prior art WNP plate manufacturing process. Smaller rolls can be used because the individual rolls can be replaced and started with the other rolls in a manner that does not result in any machine down time. When a roll is about to run out, a new roll is started on an extra unwind stand. For a while the extra product is formed and sold in the package providing an additional plate for a short period of time is far more cost effective than shutting down and restarting the forming machine every time a roll runs out. The correct formation/product package count will occur when the roll completely runs out. The ability to run rolls down to near their core also minimizes waste caused by scrap.

The punch-through die fluted female forming die and male punch are designed in a manner that there is sufficient clearance for all of the paperboard layers (thickness) to fit between the die and punch during the formation step. An additional clearance of about 20 mils more than the paperboard layers can be desirable. The total perimeter length of the flutes of the female and male dies should also be considered and configured to be approximately equal to the outer blank perimeter so the blanks do not tear or have excessive pleating when they are reduced in circumference and pass through the fluted female die. The forming ring/pressure pad is typically designed with a flute pattern to mate with the fluted female forming die to control the draw into the fluted forming die. Pins and bushings may be required to maintain accurate alignment of the forming ring/pressure pad flutes to the fluted forming die. The height of the cutting ring above the forming die is adjusted with shims so that it is approximately equal to the total thickness of paperboard that needs to be cut.

A typical punch-through die plate is formed from an about 9.375 diameter blank and has an about 6⅝ inch bottom portion, an about 1¼ inch fluted sidewall and an about ¾ inch height such that the plate is about 9 inch diameter (which is a nominal 9 inch plate). The final WNP plate diameter and height can vary somewhat depending upon the degree of sidewall relaxation that occurs after the plate is forced through the fluted female forming die. The product sidewall angle as measured from horizontal is typically less than 60° or other values as discussed previously. The fluted sidewall of the plate relaxes after it passes through the female forming die where it is substantially perpendicular to the bottom of the product.

This relaxation is different from other products formed on this class of machinery. That is to say, coffee filters, cake liners, cupcake liners and hot dog trays are formed in a manner so that they maintain a substantial height and sidewall angle typically greater than 60° from horizontal. Additionally, in such products, the flutes are typically much greater in quantity or much greater in height than the products of the present invention.

The WNP plates of the present invention can have any particular size as long as the characteristics described herein are maintained. Plates, bowls and "deep dishes" can be made with the punch-through die machinery and forming method.

There is thus provided in accordance with the present invention a WNP plate including a generally planar bottom portion; an upwardly and outwardly extending fluted sidewall, wherein the sidewall comprises a plurality of flutes arranged substantially around an outer perimeter of the plate to define a fluted perimeter, wherein the flutes are present at fewer than about 3.5 flutes per inch of circumference; a radial profile having a single transition; and a diameter/flute length ratio of greater than about 6, wherein the plate is prepared with a punch-through die forming tool. Suitably, the paperboard from which the plates are formed has a basis weight of at least about 75 lbs per ream, such as from about 75 to about 160 lbs per ream or from about 95 to about 125 lbs per ream for uncoated or lightly coated products. In many cases, basis weights of from about 85 to about 115 lbs per ream are especially suitable.

The single transition of the radial profiles of the invention may have a radius of curvature of about 0.25 inches or less, perhaps in the range of from about 0.1 inches to about 0.15 inches. The plates typically have a characteristic diameter/flute length ratio of greater than about 6 or greater than about 7 in many cases. A characteristic diameter/flute length ratio of anywhere from about 6.5 to about 9.5 is suitable for many products. Still further, the characteristic diameter/flute ratio is from about 6.5, 7.0, 7.5, 8.0, 8.5, 9.0 or 9.5, where any value can form an upper or a lower endpoint, as appropriate.

Likewise, the products of the invention usually have less than about 3 flutes per inch of perimeter, from about 1.5 to about 2.25 flutes per inch of plate perimeter being typical. Overall, a round WNP plate of the invention can have from about 40 to about 80 flutes with from about 45 to about 60 flutes being typical.

In another aspect of the invention, a method of concurrently producing a plurality of punch-through die formed WNP plates includes: feeding a plurality of paperboard webs to a punch-through die cutting and forming tool, wherein the cutting and forming tool comprises a cutting portion and a forming portion, the forming portion including a fluted punch with a fluted punch sidewall and a fluted die defining a forming passage with a fluted die sidewall, the punch and die defining therebetween a forming gap. The paperboard webs each, independently, have a basis weight of at least about 75 lbs per ream and are cut with the cutting portion of the tool to provide a stack of blanks suitable for forming into a plate. Substantially immediately, the blanks are advanced through the forming gap to form the plurality of WNP plates. The punch sidewall of the fluted punch of the cutting and forming tool has a plurality of axially extending forming ribs spaced by unfluted portions of the punch sidewall and the fluted die sidewall has a plurality of axially extending forming ribs spaced apart by unfluted portions of the die sidewall to achieve the desired geometry. Since minimal heat can be used during the forming process, the plates may be formed from polymeric coated paperboard and the polymeric coating on the paperboard may include a resin having a melting point of less than about 300° F.

The ribs of the punch and die passage may have a center-to-center spacing from each other of from about 0.25 inch to about 0.75 inch in some cases about ½ inch. The ribs can likewise have a generally triangular profile where the bases are spaced from about 0.10 inch to about 0.4 inch from adjacent ribs for a 9 inch plate. Base-to-base spacing of about 0.2 inch to about 0.3 inch is typical for a nominal 9 inch WNP plate. The ribs typically have a rib height of less than about 3/16 inch from the sidewall so that the flutes are not too deep. A rib height from about 0.15 inch to about 0.2 inch can be desirable to provide acceptable flute dimensions in the WNP plates of the present invention.

The forming angle of the die is 90° minus the inclination of the outer die ring from the axis of the tool and is generally less than about 80°. From about 65° to about 75° can be used with about 70° found to be suitable for formation of WNP plates from about 10 to about 20 or more at a time forming.

In still yet another aspect of the invention, there is provided a method of producing a stack of WNP plates. The stack can compose greater than 5 to about 20 or more individual plates. Still further, the stack can comprise from about 6, 7, 8, 9, 10, 11, 12, 13, 14, 15, 16, 17, 18, 19 or 20 or up to about 25 individual plates.

Specifically exemplified below is a method of concurrently producing a plurality of pressed paperboard plates comprising: (a) feeding a plurality of paperboard webs to a punch-through die cutting and forming tool, the paperboard having a basis weight of from about 75 lbs per square foot ream to about 160 lbs per ream, the punch-through die cutting and forming tool including: (i) a fluting die provided with (A) an outer die fluting ring transitioning to (B) an incurring fluted die portal inwardly disposed with respect to the outer die fluting ring transitioning to (C) a fluted die forming passage extending axially away from the incurving fluted die portal, the forming passage of the fluting die being provided with a plurality of circumferentially-spaced axial ribs arranged around substantially its entire periphery; (ii) a forming ram fitted with (A) an outer punch fluting ring and (B) a fluted telescoping punch, the fluted punch being provided with a plurality of circumferentially-spaced axial ribs arranged around substantially its entire periphery, and (iii) a cutting ring and (iv) a cutting anvil; (b) advancing the forming ram toward the fluting die, the components of the punch-through die forming station being configured and arranged such that upon advancement of the forming ram (i) the plurality of paperboard webs is cut into a plurality of paperboard plate blanks by cooperation of the cutting ring and cutting anvil, (ii) the outer peripheries of the paperboard plate blanks are fluted in an inclined fluting annulus defined by the outer die fluting ring and outer punch fluting ring, (iii) the paperboard plate blanks are advanced to the fluted die forming passage by way of the fluted punch which cooperates with the die to define a fluted annular forming gap extending in a production direction, the forming gap and blanks being sized such that the peripheries of the paperboard plate blanks are urged upwardly from center portions of the blanks at an angle of about 90° to form sidewalls of the WNP plates as they are advanced to the forming die passage; and (c) removing the formed WNP plates from the forming die whereupon the sidewalls of the plates relax to provide a sidewall angle moderately less than the about 90° of the forming die. Generally, the forming gap span is greater than the thickness of the stack of paperboard webs by at least the caliper of 1 layer of paperboard fed thereto and typically, the forming gap is greater than the thickness of the stack of paperboard by at least the caliper of 2 layers of paperboard fed thereto. In the apparatus illustrated in FIGS. 5-10 and described below, the fluted punch and the fluted die passage are configured and arranged such that their respective axial ribs are staggered in the forming gap during formation of the WNP plates.

Punch-through die cutting and forming tool 100 includes a plurality of die side components 112 as well as a plurality of punch side components 114. Punch side components 112 include a fluting die 116 provided with an outer die fluting ring 118 which transitions to an incurving fluted die portal 120 which, in turn, transitions to a die forming passage 122 extending axially away from portal 120. Fluted die passage 122 includes a plurality of circumferentially spaced axial forming ribs 124. There is also provided a die bolster plate 126 as well as a cutting ring 128 and some cutting ring shims 130 for spacing cutting ring 128.

Punch side components 114 include a telescoping forming ram 132 provided with a forming ram outer portion 134 as well as a forming ram inner portion 136. There is further provided a punch bolster plate 138, a punch bolster ring 140 as well as a punch shaft 142 upon which fluted telescoping punch 144 is mounted.

Punch side components further include an outer punch fluting ring 146, a retainer ring 148, as well as a cutting anvil 150.

Die side components 112 and punch side components 114 are assembled utilizing a plurality of threaded rods indicated at 152 as well as adjusting nuts indicated at 156 and jam nuts indicated at 158.

In order to form the high basis weight products of the invention, it is desirable to attach outer punch fluting ring 146 to punch bolster 140 by way of bushings and pins so that rotation of ring 146 relative to die 116 does not occur. Die side components 112 are advantageously aligned with punch side components 114 prior to making the plates of the present invention. To this end, an alignment fixture is used on the outside diameter of cutting anvil 150 and on the outside diameter of cutting ring 128 to align the tool prior to production of the WNP plates.

Figure 8:
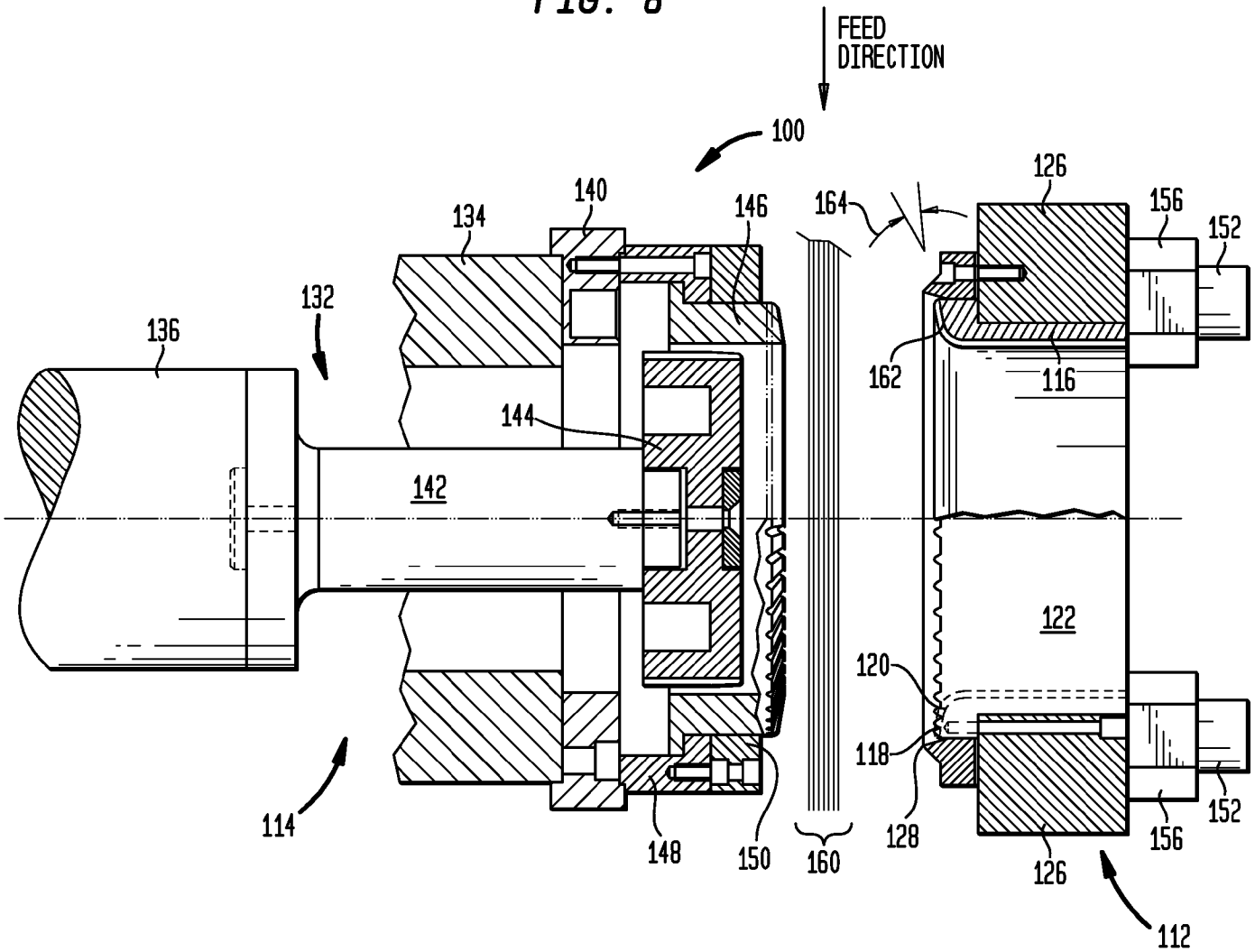
FIG. 8 is a schematic view illustrating the forming process of the present invention wherein cutting and forming tool 100 is in an open position.
Figure 9:
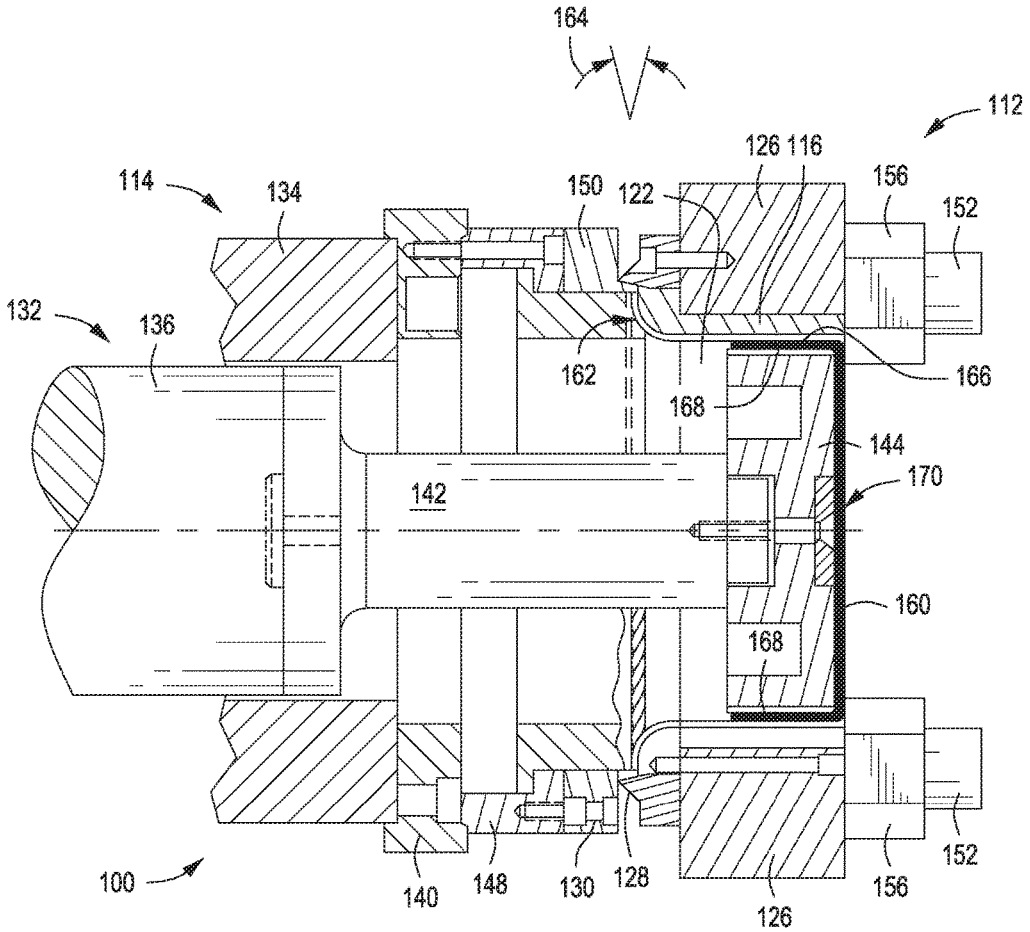
FIG. 9 is a schematic view illustrating the forming process of the present invention wherein cutting and forming tool 100 is in a closed position and the product is advanced into the fluted forming die.

Operation of the cutting and forming station is further appreciated by reference to FIGS. 8 and 9.

There is seen in FIGS. 8 and 9 punch-through die cutting and forming tool 100 in an open position and closed position respectively. In FIG. 8 tool 100 is in an open position wherein the fluted punch and forming fluting die are in spaced relation to each other. A plurality of paperboard webs indicated at 160 are advanced between the punch and fluted die. Forming ram 132 advances fluted punch side components 114 toward the die side components 112. The plurality of paperboard webs 160 are cut by cooperation of cutting ring 128 and cutting anvil 150. Once cut, the plurality of paperboard webs are held together and fluted in an inclined fluting annulus 162 defined by outer die fluting ring 118 as well as outer punch fluting ring 146. Inclined fluting annulus 162 can have an angle of inclination 164 of more than about 10° and suitably about 20° or so. The angle of inclination of the fluting annulus refers to the angle the annulus makes with a perpendicular to the axis of the punch ram or in other words, inclination with respect to perpendicular to the axis of tool 100 as shown. Forming ram portion 136 advances, plunging fluted punch 144 into the paperboard webs into the fluted die forming passage 122 and in particular into a fluted annular forming gap 166. It will be appreciated from FIG. 9 in particular, that when the WNP plates are formed in gap 166 the sidewall portions 168 of the plates are substantially perpendicular to the bottom portions of the plates as indicated at 170. The geometry of the forming gap and the geometry of the inventive plates are further appreciated by reference to FIGS. 10 and 11.

Figure 10:
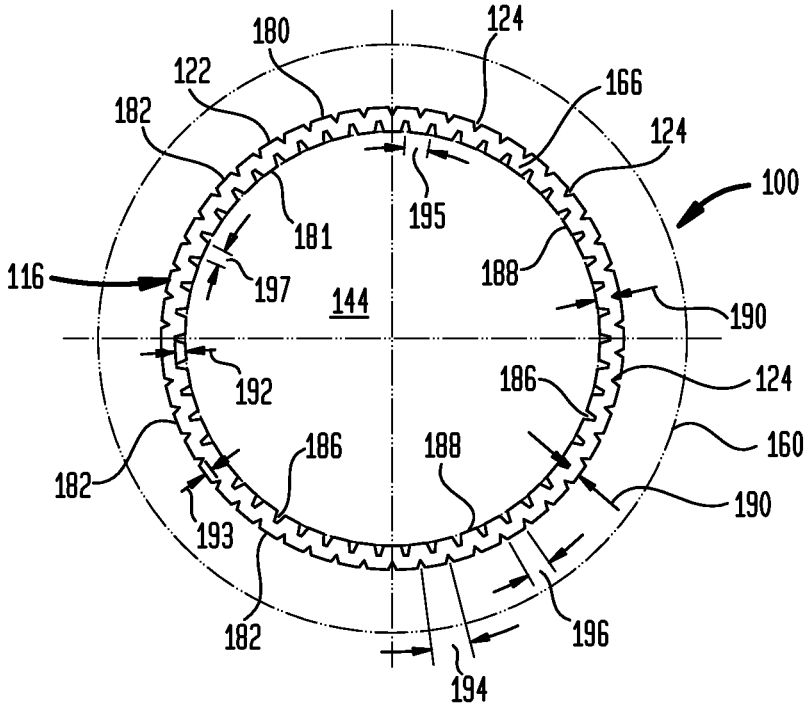
FIG. 10 is a schematic diagram partially illustrating punch and die geometry.

FIG. 10 is a schematic diagram illustrating forming gap 166 as well as a stack of paperboard blanks 160. Forming gap 166 is formed between an inner surface 180 of forming passage 122 of fluting die 116 and the outer surface 181 of punch 144. Note that circumferentially spaced ribs 124 project inwardly with respect to unfluted regions 182 of the forming passage inner surface 180. Likewise, fluted punch 144 includes a plurality of outwardly projecting ribs 186 that are circumferentially spaced apart by unfluted portions 188 of the punch. Ribs 186 are staggered with respect to ribs 124 of passage 122; that is to say, ribs 186 are in spaced facing relation to an unfluted portion 182 of the die passage whereas ribs 124 are in spaced facing relationship to an unfluted portion 188 of fluted punch 144. Generally speaking, the forming gap 166 is of a span 190 that corresponds to the thickness of the paperboard stack to be formed into a plurality of paper plates plus about 20 mils of clearance; for example a forming gap of about 220 mils is suitable for forming about 20 individual about 10 mil thick WNP plates. The punch ribs 186 can have a height 192 of about 5/32 inch or so and a radius of curvature at their apex of 30 mils or so, i.e., the ribs are quite sharp. The fluted die ribs 124 may have a height 193 of ⅛ inch or so and a radius of curvature at their apex of about 30 mils or so. For about 10 mil paperboard, the forming radius thus changes substantially over a stack of about 10 paperboard webs. A suitable center to center distance 194 between fluted die ribs 124 may be about 7/16 inch or so and the ribs may have a base to base spacing 196 of about 9/32 inch or so. A suitable center-to-center distance 195 between ribs 186 on punch 144 may be about 7/16 inch or so and the ribs may have a base-to-base spacing 197 of about 7/32 inch or so. Generally, the flutes of the plates may have a flute depth at their outer perimeter of from about 0.1 inch to about 0.18 inch in many cases.

Figure 11:
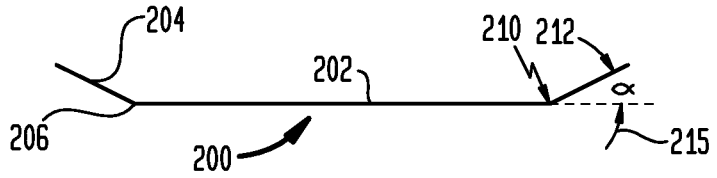
FIG. 11 is a schematic diagram illustrating product geometry.
Figure 12:
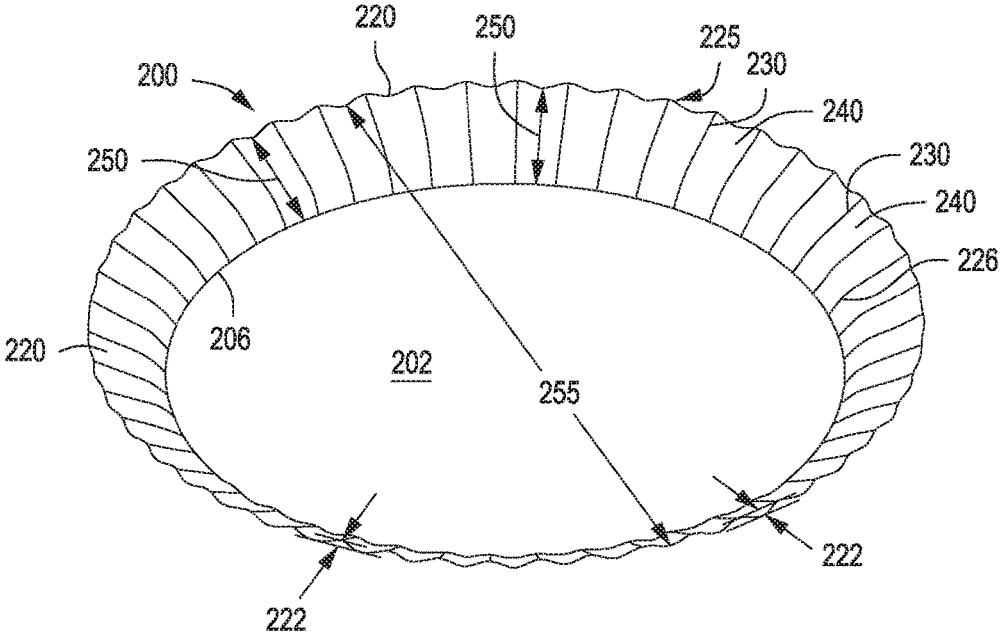
FIG. 12 is a view in perspective of a fluted plate of the invention.
Figure 13:
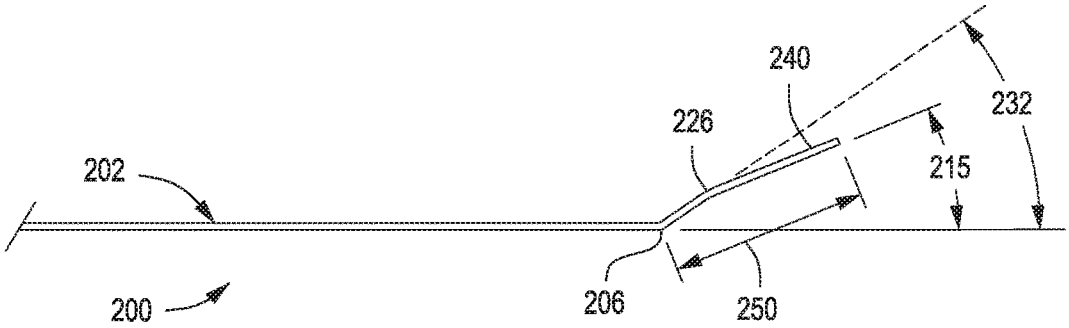
FIG. 13 is a schematic diagram illustrating radial profile of the fluted plate of FIG. 12.

Referring again to FIG. 10, it is seen that the respective ribs 124, 186 of the die and punch are staggered such that they are centered on crests and troughs of the sidewalls of WNP plates formed, as will be appreciated from FIGS. 11-13.

FIG. 11 shows generally the desired shape of a WNP plate 200 configured in accordance with the present invention. WNP plate 200 includes generally a center portion 202 and a sidewall portion 204. Note that the plate has a single radial transition 206 that is generally of a very sharp radius indicated at 210, as well as a sidewall angle a indicated as the angle between horizontal surface 215 and raised line 212. The shape of the WNP plates of the invention is slightly more complex than indicated in FIG. 11.

The WNP plates formed by the inventive process are still further appreciated by reference to FIG. 12 which shows a nominal 9 inch WNP plate 200 provided made of paperboard having a basis weight of from about 85 to about 115 lbs per ream provided with about 50 flutes 220 about its perimeter 225. Flutes 220 extend from transition 206 to a perimeter 225 of plate 200. Flutes 220 have a flute depth 222 at the perimeter of plate 200 of from about 0.1 inch to about 0.18 inch much less than a coffee filter, for example.

It will be appreciated from FIGS. 12 and 13 that a radial profile along a crest 230 of a flute 220 will have a slightly higher sidewall angle 232 than a corresponding sidewall angle, which corresponds to the angle along a trough 240 of a flute 220. For purposes of characterizing the sidewall, angle measurement is taken along a trough that is to say the characteristic angle is measured as angle; which is the minimum sidewall angle over the circumferential span of a flute. Typically, in a nominal 9 inch plate, the flutes have a length 250 of about 1⅜ inches and a flute depth 222 of slightly less than ⅛ inch or less for a plate having a diameter 255 of 9 inches or so. It is seen in FIGS. 12 and 13, that sidewall 204 of plate 200 has a slight inflection 226 due to the processes of the present invention. This feature is not a transition from, to or through horizontal and is not a substantial sidewall feature involving a substantial change in profile direction; rather the inflection is a result of stress applied to the paperboard during formation and relaxation of the sidewall area thereafter.

While the invention has been described in detail, modifications within the spirit and scope of the invention will be readily apparent to those of skill in the art. In view of the foregoing discussion, relevant knowledge in the art and references including co-pending applications discussed above in connection with the Background and Detailed Description, further description is deemed unnecessary.

What is claimed is:

1. A paperboard plate formed from a paperboard blank, comprising:

a bottom portion;

an upwardly and outwardly extending fluted sidewall portion, wherein the sidewall portion comprises a plurality of flutes arranged substantially around an outer perimeter of the bottom portion to define a fluted perimeter, wherein the flutes are present at fewer than about 3.5 flutes per inch of the fluted perimeter;

a radial profile having a single transition of about 15° to about 50° disposed between the bottom portion and the sidewall portion; and a plate diameter to flute length ratio of greater than about 6, wherein the plate has a basis weight of greater than 75 pounds per ream.

2. The paperboard plate of claim 1, wherein the plate has a basis weight of about 75 pounds per ream to about 140 pounds per ream.

3. The paperboard plate of claim 1, wherein the plate has a basis weight of about 85 pounds per ream to about 115 pounds per ream.

4. The paperboard plate of claim 1, wherein the single transition is about 15° to about 45°.

5. The paperboard plate of claim 1, wherein the fluted perimeter comprises of from about 40 to about 80 flutes, and the fluted perimeter comprises a plurality of crests and troughs without any inter-pleating therebetween.

6. The paperboard plate of claim 1, wherein the plate diameter is about 9 inches, and the single transition has a radius of curvature ranging from about 0.1 inches to about 0.015 inches.

7. The paperboard plate of claim 1, wherein the plate diameter is about 9 inches and the plate diameter to flute length ratio is of from about 6.5 to about 9.5.

8. The paperboard plate of claim 1, wherein the plate has from about 1.5 to about 2.25 flutes per inch of perimeter.

9. The paperboard plate of claim 1, wherein the bottom portion is generally planar.

10. The paperboard plate of claim 1, further comprising a polymeric coating comprising polyethylene at least partially disposed on a top side of the paperboard blank, and the plate comprises the coating on its top side.

11. The paperboard plate of claim 10, wherein the polymeric coating has a thickness of about 0.1 mil to about 2 mil.

12. The paperboard plate of claim 10, wherein the coating provides resistance to grease, water, or oil.

13. A plate formed from a paperboard blank, comprising:

a central portion;

a sidewall extending from the central portion;

a radial profile having a single angular transition disposed between the central portion and the sidewall, wherein:

the angular transition is of about 15° to about 50°;

the sidewall comprises less than about 3.5 flutes per inch, the plate has a basis weight of greater than 75 pounds per ream, and the plate has a ratio of the central portion diameter to flute length greater than about 6.

14. The plate of claim 13, further comprising a coating comprising polyethylene at least partially disposed on a top side of the paperboard blank, and the plate comprises the coating on its top side.

15. The plate of claim 13, wherein the plate diameter is about 9 inches, and the plate has a basis weight of greater than about 75 pounds per ream.

16. The plate of claim 13, wherein the angular transition is about 15° to about 45°.

17. The plate of claim 13, wherein the sidewall consists of about 40 to about 80 flutes disposed about a perimeter thereof.

18. The plate of claim 14, wherein the coating provides resistance to at least one of grease, water, and oil.

19. The plate of claim 14, wherein the coating has a thickness of from about 0.1 mil to about 2 mil.

20. The plate of claim 13, wherein the ratio of the central portion diameter to flute length ratio is of from about 6.5 to about 9.5.

21. The plate of claim 13, wherein the number of flutes per inch of a perimeter of the sidewall is of from about 1.5 to about 2.25.

22. The plate of claim 13, wherein the central portion is generally planar.

23. A plate formed from a paperboard blank, comprising:

a central portion;

a sidewall extending from a perimeter of the central portion;

a single angular transition of from about 15° to about 60° disposed between the central portion and the sidewall;

at least one inflection disposed on the sidewall; and of from about 40 to about 80 flutes disposed on the side wall at less than about 3.5 flutes per inch, wherein:

the sidewall has no pleats;

the central portion diameter is about 9 inches;

a ratio of the central portion diameter to flute length is greater than about 6; and the plate has a basis weight of greater than about 75 pounds per ream.

24. The plate of claim 23, wherein each inflection comprises a curve.

25. The paperboard plate of claim 23, wherein the plate has a basis weight of about 75 pounds per ream to about 140 pounds per ream.

26. The paperboard plate of claim 23, wherein the plate has a basis weight of about 85 pounds per ream to about 115 pounds per ream.

27. The paperboard plate of claim 23, wherein the plate has a basis weight of about 85 pounds per ream to about 130 pounds per ream.

* * * * *